United States Patent [19]

Powell et al.

[11] 4,440,461

[45] Apr. 3, 1984

[54] SLIDE ARRANGEMENT

[75] Inventors: George G. Powell; Reece J. Powell, both of Broadford, Australia

[73] Assignee: Sinclair & Powell Proprietary Limited, Victoria, Australia

[21] Appl. No.: 253,856

[22] PCT Filed: Aug. 7, 1980

[86] PCT No.: PCT/AU80/00045

§ 371 Date: Apr. 6, 1981

§ 102(e) Date: Apr. 6, 1981

[87] PCT Pub. No.: WO81/00349

PCT Pub. Date: Feb. 19, 1981

[51] Int. Cl.[3] ..... A47B 88/00

[52] U.S. Cl. ..... 312/330 R; 312/330 SM; 312/343; 312/338; 312/348; 308/3.6

[58] Field of Search ..... 312/330 R, 330 SM, 338, 312/348, 350, 343, 333, 344, 341 R, 341 NR, 339, 342, 340; 308/3.6, 3.8

[56] References Cited

U.S. PATENT DOCUMENTS

| | | | |
|---|---|---|---|
| 1,231,291 | 6/1917 | Otte | 312/338 |
| 1,301,495 | 4/1919 | Otte | 308/3.6 |
| 1,859,228 | 5/1932 | Berry | 312/338 |
| 1,873,933 | 8/1932 | Hunter | 312/330 R |
| 2,277,702 | 3/1942 | Kennedy . | |
| 2,277,703 | 3/1942 | Kennedy et al. . | |
| 2,295,697 | 9/1942 | Sulentic . | |
| 2,880,040 | 3/1959 | Gomersall | 312/343 |
| 3,059,986 | 10/1962 | Miller, Jr. . | |
| 3,160,448 | 12/1964 | Abernathy et al. | 312/343 |
| 3,462,208 | 8/1969 | Black et al. | 312/330 R |
| 3,726,579 | 4/1973 | Ullman, Jr. | 312/330 R |
| 3,729,242 | 4/1973 | Barney | 312/330 R |
| 4,072,375 | 2/1978 | Boone | 312/338 |
| 4,272,139 | 6/1981 | Fler | 312/333 |

FOREIGN PATENT DOCUMENTS

| | | |
|---|---|---|
| 2036362 | 1/1972 | Fed. Rep. of Germany . |
| 648493 | 12/1928 | France . |
| 253682 | 11/1948 | Switzerland . |
| 334983 | 2/1959 | Switzerland . |
| 1158397 | 7/1969 | United Kingdom . |

*Primary Examiner*—Victor N. Sakran
*Attorney, Agent, or Firm*—Keil & Witherspoon

[57] ABSTRACT

A receptacle comprising a housing (14) and drawers (15) and (16). Drawers (15) and (16) having ends (17) provided with an integral upper ridge (18) and integral lower ridge (19). Housing (14) having end panels (23) provided with inwardly facing integral ridges (21) and indents (22). Coacting between the integral ridges is a floating element (8) which permits the drawers (15) and (16) to slide in and out of the housing (14).

5 Claims, 26 Drawing Figures

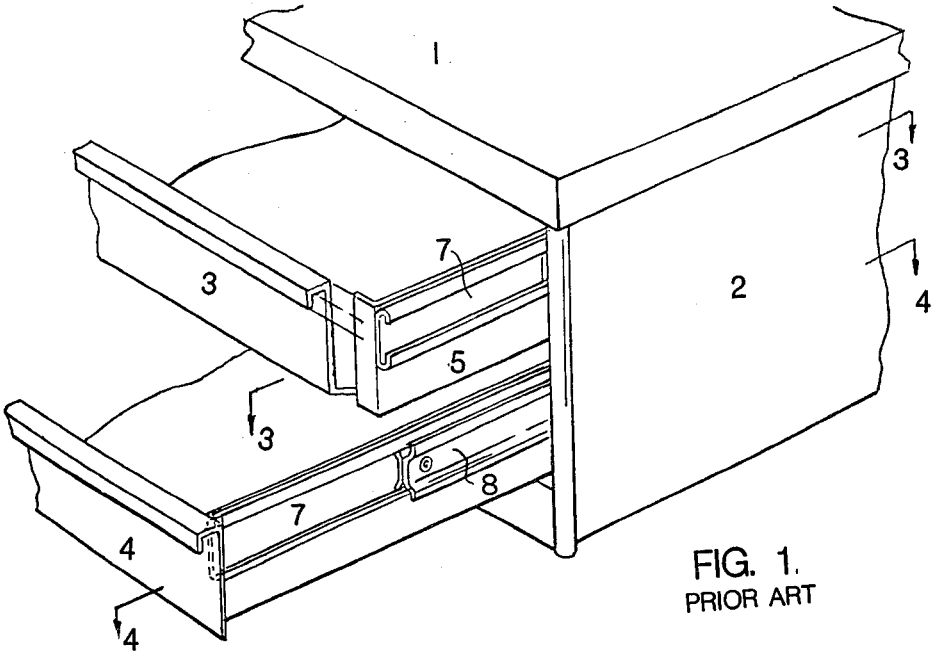
FIG. 1.
PRIOR ART
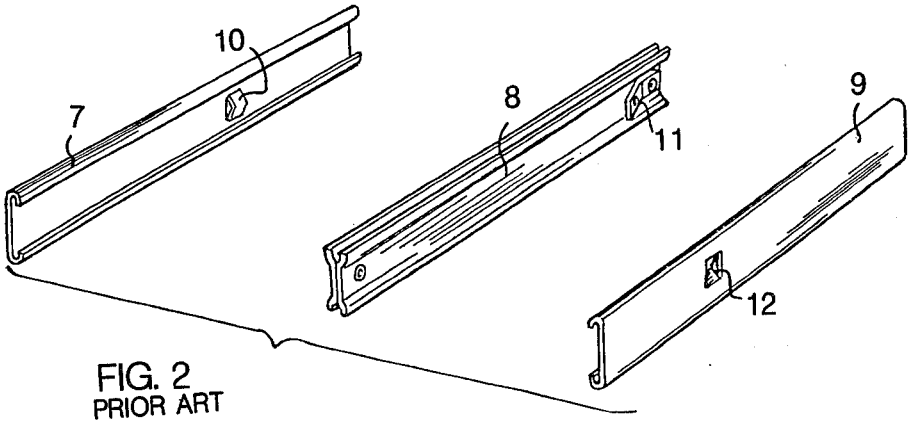
FIG. 2
PRIOR ART
FIG. 3
PRIOR ART
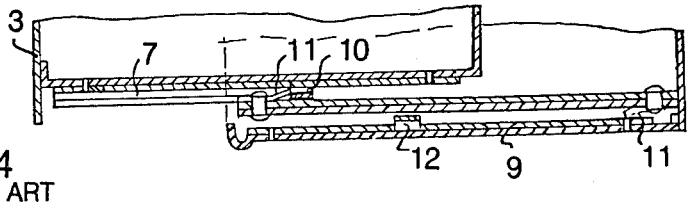
FIG. 4
PRIOR ART
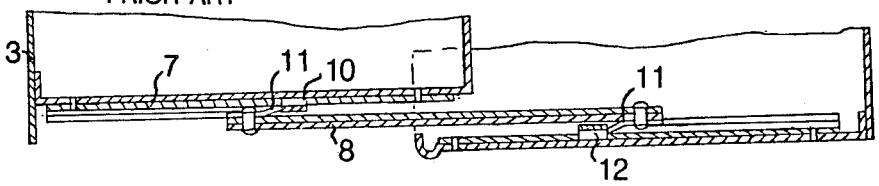

FIG. 8
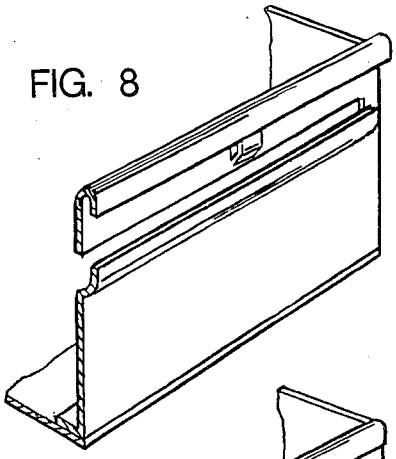
FIG. 9
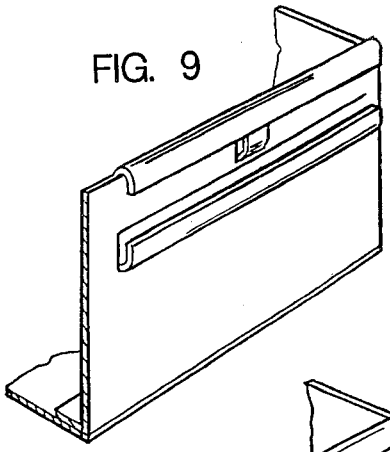
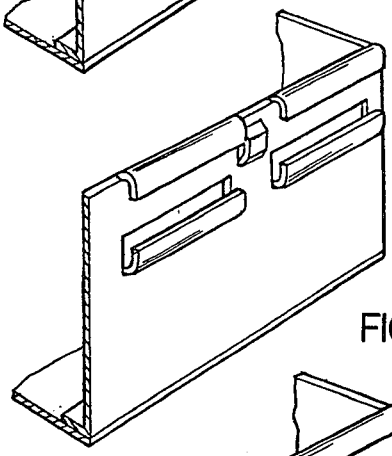
FIG.10
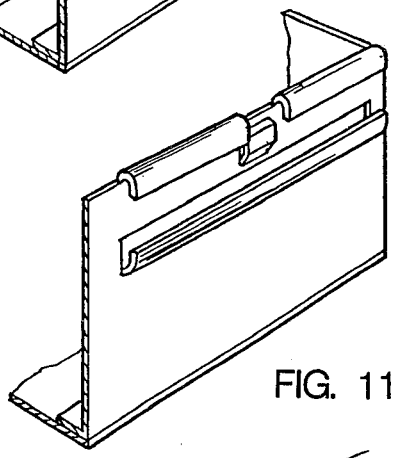
FIG. 11
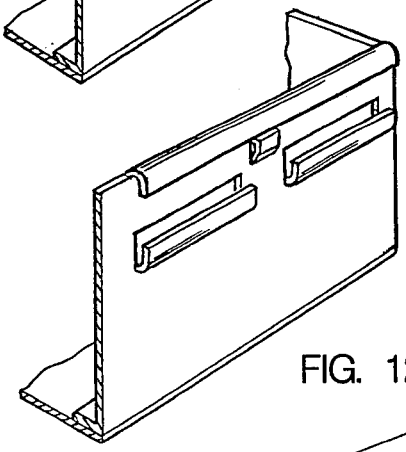
FIG. 12
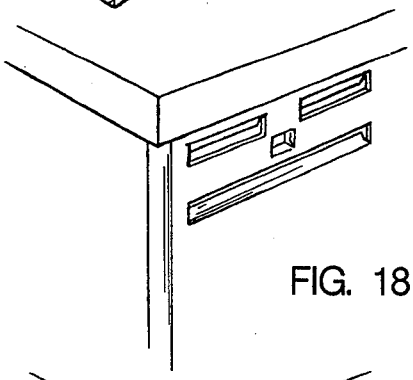
FIG. 18
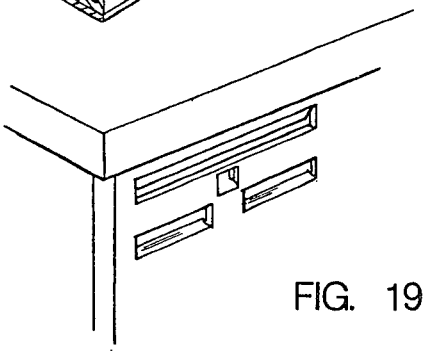
FIG. 19
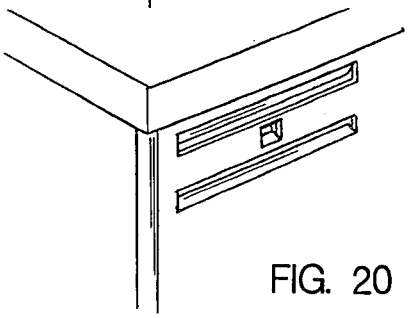
FIG. 20

FIG. 21
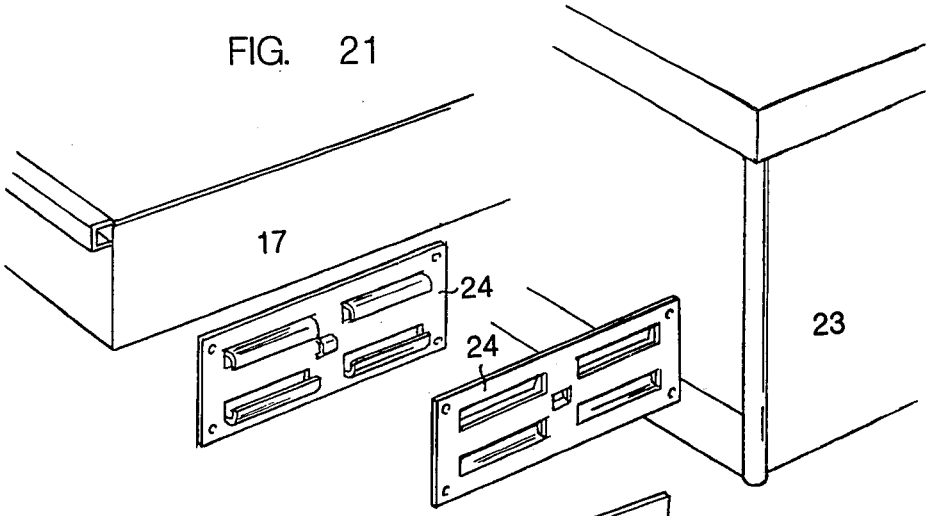
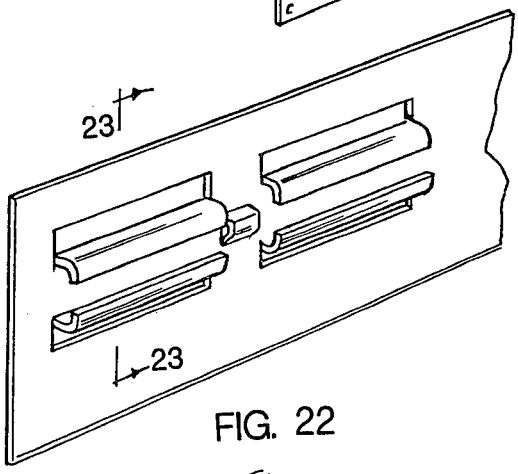
FIG. 22
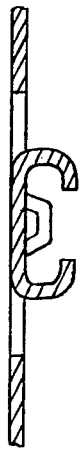
FIG. 23
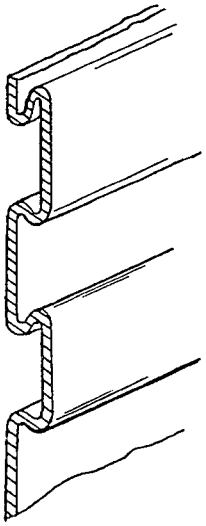
FIG. 24

SLIDE ARRANGEMENT

The invention relates to a slide means for drawers, more particularly for slides used in boxes. Whilst the following description discusses tool boxes and boxes in general the present invention is not so limited to use therein.

In the past there have been many means of facilitating the sliding motion of a drawer in a box or cabinet. These means basically provide a transverse support along the inside face of both ends of the box or cabinet. The drawer is supported by these supports and slides thereon. This means is particularly suited to boxes or cabinets of wooden fabrication where the attachment of the slides can be achieved by nailing or screwing. However, when considering tool boxes or cabinets, drawers must be supported in the various open positions as they may contain many heavy items. In this respect the aforementioned slide means provides inadequate. Additionally in view of the above criteria it is usual to fabricate tool boxes of metal hence nailing or screwing is not an appropriate fixing method. Basically with these types of tool boxes an attachment of drawer supports requires the provision of nuts and bolts or welding. As previously mentioned, as the load which must be carried by the drawers of tool boxes is much greater than for conventional drawers it is imperative when the drawer is pulled out that it be properly supported. To meet this need it is common to provide a support which utilizes a floating slide member.

In this respect the normal tool box drawer slide support structure comprises a set of three elements for each end of the drawer and box. The first element of each set is bolted or welded to the inside end faces of the box and is normally an inturned channel section. The second element of each set which is similarly of inturned channelled material is attached to a side of the drawer. In contrast to the first and second elements the third element is of general I beam cross-section and adapted to slidingly engage both first and second elements. Where this system is used it is undesirable to have either first or second elements disengaging from the floating member, i.e. the third element and accordingly, it is conventional to have engageable stop means attached to each element to prevent this from occurring. Thus in operation when the drawer is closed it is supported at each end by the three elements in interfitting engagement. In the open position the third element maintains continuity between the first and second element and permits the drawer to be fully opened. By "continuity" it is meant that the three elements are in telescopic relationship. More particularly the third element floatingly supports the weight of the drawer by distributing the drawer's weight over the three elements. The use of a channelled floating member has been found to be a very effective means of drawer support, however, it has some basic disadvantages. Firstly that system comprises three interengaging elements, the first and second elements being channelled and thus must be specially formed. Secondly, as these aforementioned two elements for each end of the box are channelled they are difficult to manually affix to the box and drawer respectively. This second aspect has added to fabrication costs. Accordingly whilst this system is best for tool boxes considering the load characteristics and robust requirements of these boxes, it nevertheless complicates the fabrication with a corresponding increase in cost.

In addition to this the conventional floating member comprises two pressed elements, these elements when attached together form a channel. In this respect the only type of affixing used is riveting by way of separate rivet elements. Thus to effect fixing, each of the pressed elements has at least two aligned holes drilled therein, then the elements connected by insertion of rivets through the aligned holes and subsequent deformation of the protruding portions of said rivets. As mentioned previously a stop element is attached to each end of the floating member. This is incorporated by the attachment of a separate upstanding tab of spring steel at each end. Typically this tab has a hole therein and can be simultaneously affixed by said rivet means when the pressed elements are being affixed.

This conventional floating member suffers from some basic design faults. In this respect the assembly of the floating member is necessarily complex and labour intensive having regard to its design. Such faults can be more accurately pinpointed as (1) necessarily providing specific piercing operations and separate rivet elements; and (2) the incorporation of the stops aforementioned as separate members which consequently complicates assembly.

With the aforegoing disadvantages in mind the problem of use of multi component drawer slide systems was investigated in an effort to eliminate these disadvantages whilst maintaining the advantages.

Accordingly there is provided in one embodiment of the invention a receptacle comprising a housing which is characterized by at least two generally parallel internal faces and drawer means adapted to be housed in said housing and having at least two generally parallel external faces, one or more of said internal faces and/or said external faces having integral slide guide means formed therein, said guide means being adapted to receive a floating slide.

According to a further embodiment of the invention there is provided a receptacle comprising a housing which is characterized by at least two generally parallel internal faces and drawer means adapted to be housed in said housing and having at least two generally parallel internal faces, one or more of said internal faces and/or said external faces having a planar or corrugated guide means attached thereto, said guide means being adapted to receive a floating slide.

In a preferred embodiment of the invention the receptacle is a box of conventional shape having one or more drawers disposed therein, the ends of the box and respctive adjacent sides of the drawer having integrally formed therein, guide means such that a single floating guide means may be used on each side of the box and drawer. To prevent the drawer from disengaging the box when brought into the fully open position, it is necessary to incorporate stop means. Such means can take any form and an example of this is illustrated in the drawings.

In an alternate form of the invention as set out in the second embodiment aforementioned, the integrally formed guide means can be substituted by a planar or corrugated guide means. Typically these guide means comprise a plate with guides integrally incorporated therein. Positioning and securing such to the sides or faces of the drawer or box can be easily carried out with screws, bolts or spot welding. Preferably this type of guide means covers a large portion of the area of at least the drawer face. Because of the substantial nature of the guide means in comparison with the commonly used channelled section, same are easily positioned and held ready for affixing to the face. As mentioned above the guide means may be corrugated as an alternative to the planar configuration. In this alternative the corrugations can additionally constitute the guide means for the floating slide.

Typically when the box and/or drawer is fabricated of metal the formation of integral guide means is accomplished by pressing an appropriate portion of the metal. Similarly in the alternate embodiment of the invention the guides in the planar or corrugated guide means can be stamped out.

These guide means preferably are a pair of spaced apart inwardly inclined generally parallel ridges which retain the guide whilst still permitting relative sliding motion. Instead of one pair of spaced apart ridges it can be desirable for the guide means to comprise more than one pair, such pair would of course need to be axially aligned with the first mentioned pair to permit the sliding action. In a further alternative one of the ridges in the pair could be continuous whilst the other discontinuous. Such still allows the sliding action as would the construction of a plurality of pairs of axially spaced small inwardly faced projections. Similarly as aforementioned corrugations can be used.

In a separate aspect of the invention there is provided a floating member for use in a drawer slide assembly which comprises a body portion and at least one projection, characterized by the fact that the or at least one of said projections is formed integrally from said body portion.

Referring to the conventional body portion which comprises two pressed members, the projection(s) may be formed in accordance with the invention by stamping said members. Thus the upstanding projection or tab is an integral part of the respective members. Obviously the slide members may take on any convenient form to facilitate sliding in said first and third elements of the whole slide mechanism. Further the floating member and integral projection, if a plastic fabrication material is selected, may be formed simply by injection moulding.

The provision of integral stops in the floating member elements whilst appearing a simple invention does exhibit superior characteristics to those of the conventional stop. More particularly extensive experiment has found that by the aforementioned integral forming it is possible to enhance the life of the projection some 900 percent.

In this respect a comparitive test of a conventional floating member which uses a spring steel stop to a metal projection according to this aspect of the invention was as follows: Both types of floating members were tested to destruction of their respective stops by reciprocal inward and outward movement of a drawer to which they were attached. The drawer was fitted with a 30 lb. weight which was operated at 46 strokes/-minute having a length of stroke of $6\frac{7}{8}''$. The spring steel stop of the conventional floating member failed at approximately 11,000 strokes whilst the integral stop failed at approximately 95,650 strokes.

In addition to the above illustrated toughness of the new type of projection by making same integral it is possible to form same automatically when forming each of the component members. Thus a handling step of fabrication is eliminated with consequent production cost reduction.

In another separate aspect of the invention the other design fault associated with the conventional floating slide regarding the necessity of providing specific piercing operations and separate rivet elements, can be substantially eliminated. In this respect a floating member for use in a drawer slide assembly is provided which comprises a body portion composed of at least two elongated members, one of said members having at least one aperture whilst the other member is provided with at least one integrally formed upstanding projection, such that said members are adapted to be fixedly attached to each other by alignment of said upstanding projection with said aperture, passing said projection through said aperture and subsequently deforming said projection to prevent its disengagement from said aperture.

The projection aforementioned may be generally termed an integral rivet. In this respect whilst this aspect of the invention may appear simple, problems were encountered when trying to achieve this. Basically formation of an integral rivet is carried out by careful extrusion. Typically where each elongated member is pressed it is necessary to affix same together at two points. The basic advantage of integrally forming the affixing means in said members is the simplification of assembly. No longer is it necessary to have a separate source of rivets as they are already in situ. Further not only is that element not necessary but it is also possible to integrate the rivet formation in the prior pressing operations. Again these advantages have the effect of providing an immediate fabrication cost benefit.

As will be appreciated from the above there are a number of aspects to the invention which each separately gives certain advantages. Whilst the following description describes these aspects in combination it is not intended the invention be so limited.

The floating member may be made in accordance with the invention by the following steps:

A combination follow and transfer press tool is fitted to a crank press, with provisions for automatic roll feed of steel strip. The strip approaches a first stage which crops part profile and pierces four holes. Thereafter in a second stage the final profile is cropped and channel section formed. Extrusion of two rivets from the profile and formation of integral stop follows in a first stage transfer whilst in a subsequent second stage transfer, the components are combined and rivetted together to form a floating member according to the invention. Obviously the extruded rivet may take on any workable shape. The most convenient shape is circular in plan view. Other possible shapes include round, oval, elliptical, square, square with rounded corners, rectangular with rounded corners, triangular, and triangular with rounded corners.

The present invention is now illustrated with reference to the following drawings in which FIG. 1 is a perspective view of a conventional tool box.

FIG. 2 is a perspective component view of the sliding elements used in the conventional tool box of FIG. 1.

FIG. 3 is a plan cross-sectional view of the sliding mechanism of the tool box of FIG. 1 in a partially open position.

FIG. 4 is a plan cross-sectional view of the sliding mechanism of the tool box of FIG. 1 in a fully open position.

FIGS. 7 to 17 are alternate configurations of a drawer end panel made in accordance with the invention.

FIGS. 18 to 20 are alternate configurations of a box end panel made in accordance with the invention.

FIG. 21 shows a tool box incorporating an alternate form of the invention.

FIGS. 22 to 24 show other configurations of the present invention.

Figure 5:
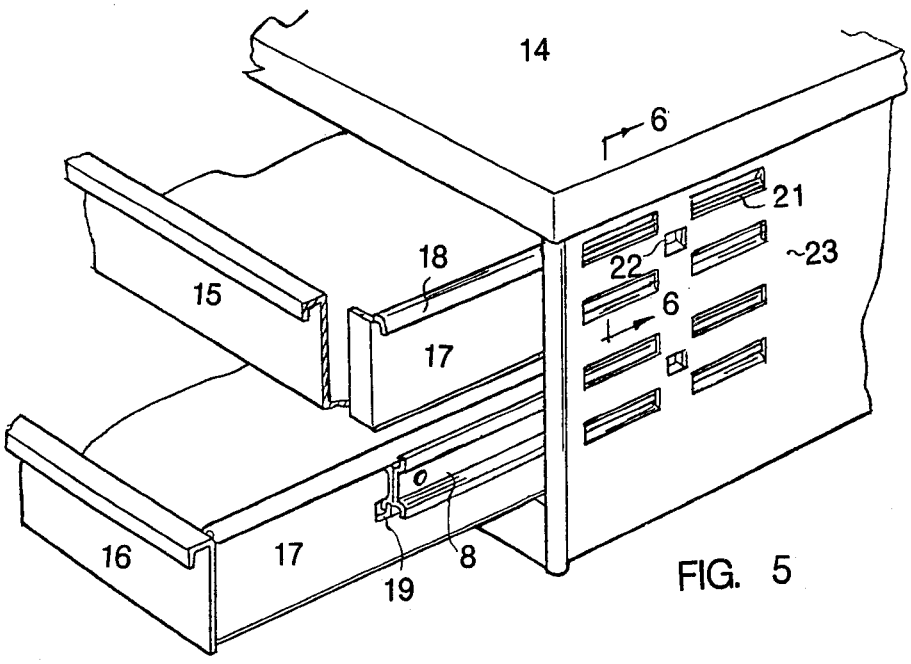
FIG. 5 is a perspective view of a tool box made in accordance with the present invention.

In FIG. 1 a partially opened conventional tool box 1 is shown comprising a housing 2 and drawers 3 and 4. Each of drawers 3 and 4 have end panels 5 to which is affixed a track section portion 7. As is more clearly shown in FIG. 2 a floating member 8 is provided with slidingly engages section 7 on the drawer. Similarly a track section portion 9 is affixed to the inside end face of the housing 2 and likewise slidingly engages floating member 8. Sections 7 and 9 are characterized by indents 10 and 12 respectively whilst member 8 has stop members 11 and 11' (not shown) affixed to each end thereof on opposing sides.

Reference to FIGS. 3 and 4 show how the sliding motion of the drawers 3 and 4 relative to the housing 2 is achieved. More particularly in FIG. 3 as drawer 3 is moved to the left, channel section 7 which is affixed to end panel 5, slides along floating member 8. At the position shown in FIG. 3 indent 10 has come into engagement with the stop member 11' of floating member 8. For further movement of the drawer 3 out of the housing, floating member 8 begins to slide along section 9. As drawer 3 approaches its fully opened position, as shown in FIG. 4, the stop member 11 approaches indent 12 of section 9 and once engaged no further outward movement of the drawer can occur. At all times during opening and closing of drawer 3, same is supported by the three members 7, 8 and 9 due to the telescopic arrangement. The incorporation of stops and indents is to avoid the drawer 3 from disengaging the housing 2, which unexpected disengagement could cause injury to a worker. The foregoing is a description of the basic sliding system presently utilized in tool boxes or the like.

Figure 7:
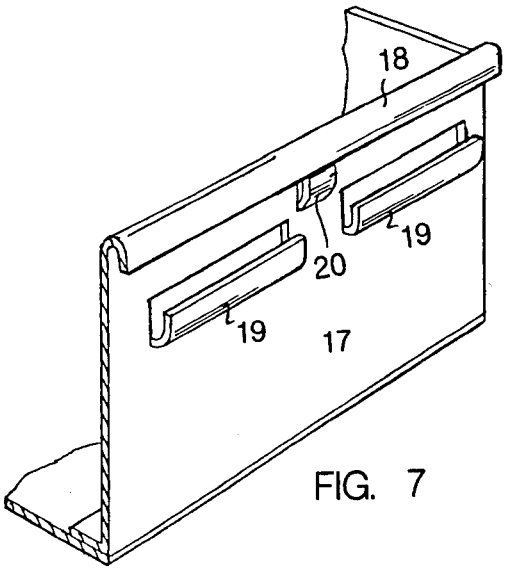
Figure 6:
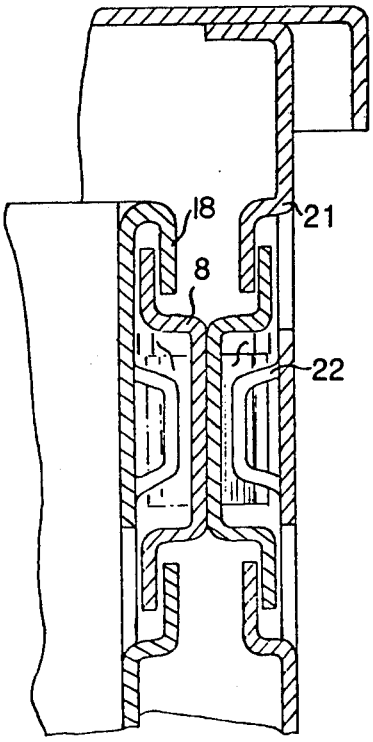
FIG. 6 is a transverse cross-sectional view of the sliding mechanism of the tool box of FIG. 5.
Figure 13:
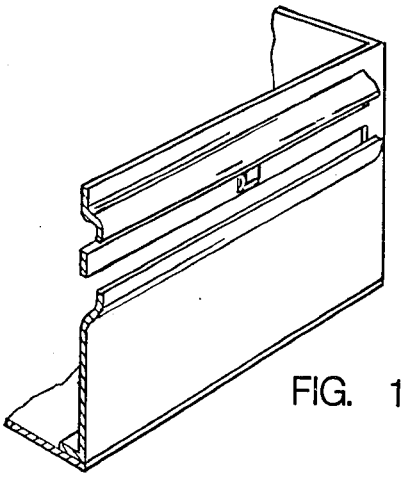
Figure 14:
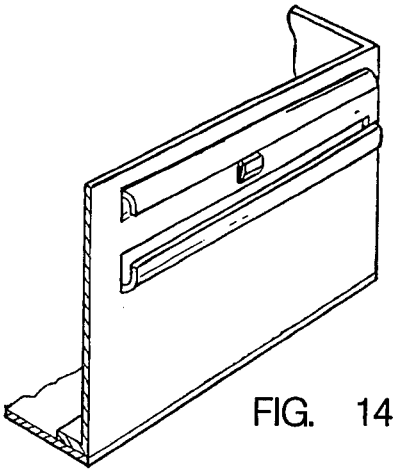
Figure 15:
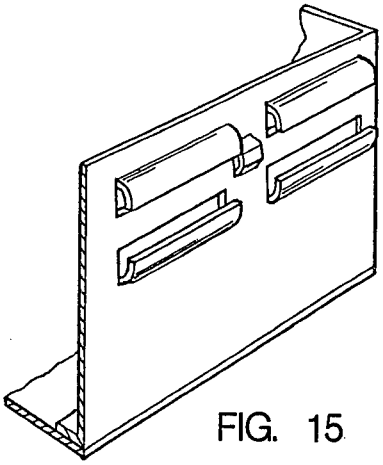
Figure 16:
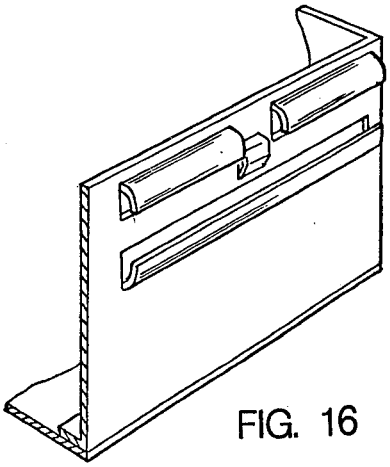

In FIG. 5 a partially opened tool box 13 made in accordance with the present invention is shown. This tool box 13 comprises a housing 14 and drawers 15 and 16 similar to conventional boxes except that the sections 7 and 9 aforementioned are integral formations in the ends of said housing 14 and sides 15 and 16. More particularly drawer ends 17 are provided with an upper ridge 18 and lower ridge(s) 19 (see FIG. 7) whilst the end panel 23 of housing 14 is provided with inwardly facing ridges 21 and indent 22 (see FIG. 6). Accordingly as more explicitly shown in the partial view of the drawer end 17 (FIG. 7) and transverse cross-section (FIG. 6) floating member 8 slidingly engages the set of drawer ridges 18 and 19 as well as a set of housing ridges 21. When drawer 15 is pulled away from housing 14, its ridges 18 and 19 slide along floating member 8 until indent 20 engages stop 11' whereafter member 8 slides along ridges 21. As the drawer 15 reaches its fully opened position member 8 engages indent 22 by reason of stop member 11 and thus the drawer cannot move further outward. The provision of these integral ridges in which the floating member 8 slides considerably simplifies the manufacture of the tool box and obviates the necessity of having a person precisely position section members 7 and 9.

Figure 17:
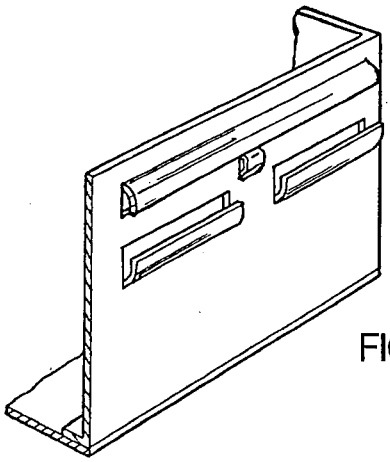

FIGS. 8 and 17 show alternate forms of the ridging of end 17 which still utilize the principle of the invention. Similarly FIGS. 18 to 20 display similar alternate forms of ridging of the end panel 23 and it is believed there is no need for further explanation of these.

As referred to earlier as a second embodiment of the present invention it is still possible to considerably simplify fabrication cost especially where the box and/or drawer is wooden or plastic where it is not desired to have an outward face showing the ridges 21. In these cases, as shown in FIG. 21, it is possible to provide the slide means on a plate which covers a substantial part of the drawer end 17 and/or end panel 23. With such a substantial part 24 it is very easy to affix in that it can be aligned with ease.

In FIGS. 22 to 24 alternate forms suitable for integral formation or for attachment are given.

Figure 25:
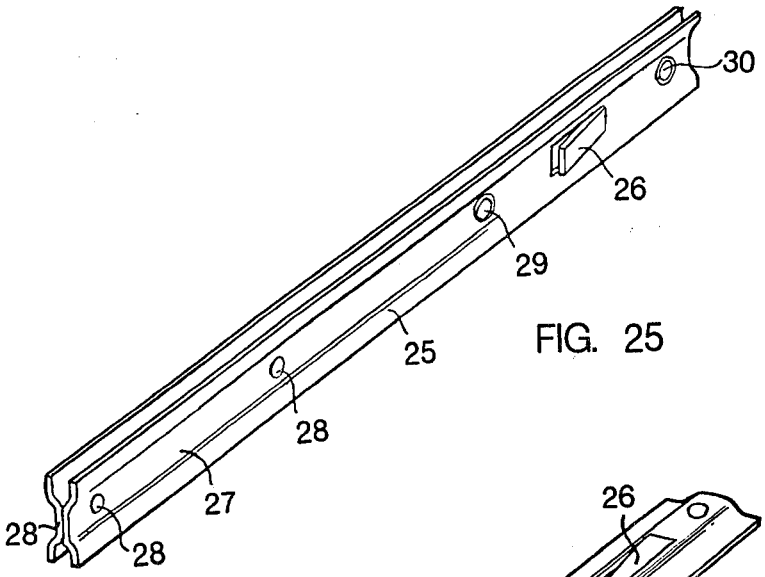
FIG. 25 is a perspective view of a floating slide made in accordance with the present invention.
Figure 26:
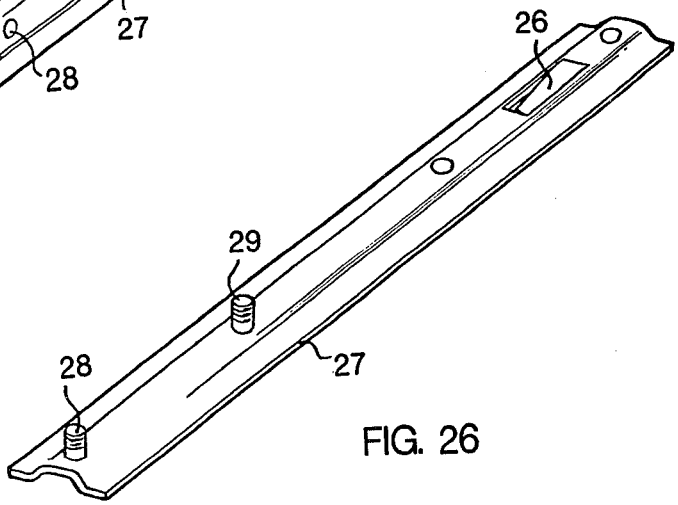
FIG. 26 is a perspective view of one of the component parts of the floating slide of FIG. 25.

In FIG. 25 a floating member 25 made in accordance with the invention is shown which can be substituted for member 8. A stop 26 is provided by integral formation from the member 25. As previously mentioned this can be stamped out or in the case of plastics integrally injection moulded. Basically member 25 comprises two elements 27 and 28 rivetted together (see FIG. 26). Element 27 in its form prior to assembly has rivet extrusions 29 which during assembly penetrate through and extend from apertures provided in the mating element. Thereafter the rivet is deformed as shown as 30 in FIG. 25.

We claim:

1. A metal receptacle comprising (a) a housing having two generally parallel internal surfaces, each of which is provided with guide means, said guide means being integrally formed in at least one of said surfaces and comprising at least one pair of spaced, generally parallel ridges;

(b) drawer means located in the housing and having two generally parallel external surfaces each of which is adjacent one of said internal surfaces;

(c) floating slide means communicating between respective pairs of said internal and external surfaces to facilitate sliding movement of the drawer means into and out of the housing, said slide means having a first portion engaging the guide means and a second portion engaging said drawer means.

2. A metal receptacle according to claim 1 wherein the guide means covers a large portion of the area of the external faces.

3. A receptacle according to claim 1 wherein at least one of said ridges is discontinuous.

4. A receptacle according to claim 1 wherein said floating slide means comprises two elongated members, one of said members having at least one aperture whilst the other member is provided with at least one integrally formed upstanding projection, such that said members are adapted to be fixedly attached to each other by alignment of said upstanding projection with said aperture, passing said projection through said aperture and subsequently deforming said projection to prevent disengagement of said elongated members.

5. A receptacle according to claim 1 wherein said slide means further includes a stop means to prevent disengagement of said first portion from said guide means, and/or disengagement of said second portion from said drawer means, said stop means being integrally formed in said slide means adjacent one end thereof and including a surface inclined away from said slide means in the direction of the other end of said slide means.

* * * * *